US005773735A

United States Patent [19]

Dubensky et al.

[11] Patent Number: 5,773,735

[45] Date of Patent: Jun. 30, 1998

[54] DENSE FINE GRAINED MONOTUNGSTEN CARBIDE-TRANSITION METAL CEMENTED CARBIDE BODY AND PREPARATION THEREOF

[75] Inventors: Ellen M. Dubensky; Robert T. Nilsson, both of Midland, Mich.

[73] Assignee: The Dow Chemical Company, Midland, Mich.

[21] Appl. No.: 752,513

[22] Filed: Nov. 20, 1996

[51] Int. Cl.[6] ..... C22C 29/00

[52] U.S. Cl. ..... 75/240; 75/242; 419/18; 419/32; 419/48

[58] Field of Search ..... 75/240, 242; 419/18, 419/32, 48

[56] References Cited

U.S. PATENT DOCUMENTS

| | | | |
|---|---|---|---|
| 3,455,682 | 7/1969 | Barbaras | 25/204 |
| 4,145,213 | 3/1979 | Oskarsson et al. | 75/238 |
| 4,851,041 | 7/1989 | Polizzotti et al. | 75/240 |
| 4,923,512 | 5/1990 | Timm et al. | 75/239 |
| 4,945,073 | 7/1990 | Dubensky et al. | 501/93 |
| 5,215,945 | 6/1993 | Dubensky et al. | 501/945 |
| 5,288,676 | 2/1994 | Shimada et al. | 501/93 |
| 5,334,561 | 8/1994 | Matsui et al. | 501/87 |
| 5,338,330 | 8/1994 | Polizzotti et al. | 75/228 |
| 5,368,628 | 11/1994 | Friederichs | 75/242 |
| 5,441,553 | 8/1995 | Polizzotti et al. | 75/230 |
| 5,476,531 | 12/1995 | Timm et al. | 75/240 |
| 5,490,968 | 2/1996 | Polizzotti et al. | 419/2 |
| 5,580,666 | 12/1996 | Dubensky et al. | 428/552 |

FOREIGN PATENT DOCUMENTS 0665308 1/1994 European Pat. Off. .

OTHER PUBLICATIONS

Almond et al., "Very–Fine–Grained Hardmetals," International Journal of Refractory & Hard Metals, vol. 6, No. 3, Sep. 1987.

Bock et al., "Powder Metallurgy—Inhibition of Grain Growth on Submicron Cemented Carbides," pmi, vol. 24, No. 1, pp. 20–26 (1992).

Fang et al., "Study of Nanostructured WC–Co Composites," International Journal of Refractory Metals & Hard Materials, vol. 13, No. 5, pp. 297–303 (1995).

(List continued on next page.)

*Primary Examiner*—Ngoclan Mai

[57] ABSTRACT

A cemented tungsten carbide body having a transition metal binder phase selected from the group consisting of iron, nickel and cobalt is formed, wherein the WC grains have an average WC grain size of at most about 0.5 micrometer in diameter and a maximum WC grain size of at most about 0.8 micrometer in diameter. Also, about 50 percent by volume of the WC grains in the body are angular grains and the body (1) contains an amount of the transition metal ranging from about 3 percent to about 18 percent by weight of the body, (2) is essentially free of grain growth inhibitors and (3) is essentially pore free. Said cemented tungsten carbide body is formed by mechanically mixing a source of WC with a source of transition metal, shaping the mixture into a porous body and sintering the porous body at a sintering temperature, superatmospheric pressure and time at temperature and time at superatmospheric pressure sufficient to form the cemented tungsten carbide body, wherein the sintering occurs without the formation of a liquid in the body and at least a portion of the time at superatmospheric pressure is at the sintering temperature.

22 Claims, 2 Drawing Sheets

OTHER PUBLICATIONS

McCandlish et al., "Control of Composition and Microstructure in the Wo–W–C System Using Chemical Synthetic Techniques," Solid State Ionics, 32/33, pp. 795–801 (1989).
Pastor, "Present Status and Development of Tool Materials: Part 1 Cutting Tools," R&HM, Dec. 1987, pp. 196–209.
Pastor, "Present Status and Development of Tool Materials: Part 2 Drilling/Mining and Wear Parts," R&HM, Mar. 1988, pp. 21–28.
Schubert et al., "General Aspects and Limits of Conventional Ultrafine WC Powder Manufacture and Hard Metal Production," Int. J. of Refractory Metals & Hard Materials, vol. 13, pp. 281–296.
Wu et al., "Grain Growth Inhibition in Sintering of Nanostructured WC–Co Alloys," Conference: 13th International Plansee Seminar '93, vol. 3: Coating Technology, Reutte, Tirol, Austria, 24–28 May 1993.
Chemical Abstracts, 124:13457h, "Hard materials and their manufacture," JP 07,216,492, 1995.
Chemical Abstracts, 122:61681g, "Manufacture of tungsten carbide–base hard alloys with strength and hardness," JP 06,264,158, 1994.
Chemical Abstracts, 121:114713g, "Sintering of ultrafine Wc/Co hard metals," Bock et al., Proc—Int. Conf. Adv. Hard Mater. Prod., 1992.
Chemical Abstracts, 114:251696y, Ultra–submicron hardmetals for miniature drills, 1990.
CA 2020–093, "Composite hard abrasion resistant article is formed from precursor particles of metallic matrix contg. non–metallic cpd. particles," Derwent 91–087629/13.
JP 07292426, "Lamellar tungsten carbide–contg. cemented carbide prodn.–using bonding phase–forming Powder, ect.," Derwent 96–017562/02.

DENSE FINE GRAINED MONOTUNGSTEN CARBIDE-TRANSITION METAL CEMENTED CARBIDE BODY AND PREPARATION THEREOF

FIELD OF THE INVENTION

The invention relates to a tungsten carbide-transition metal cemented carbide body and method to prepare said body.

BACKGROUND OF THE INVENTION

Monotungsten carbide-transition metal cemented carbide parts are useful as commercial wear items such as cutting tools, dies and drilling tools. Cemented carbide parts, generally, have properties that are a compromise between catastrophically breaking (e.g., toughness or strength) and wearing away too quickly (e.g., hardness), while being used in an application such as a cutting tool. Generally, as the grain size of the cemented carbide decreases the wear resistance of the part improves. However, as the grain size decreases, the processing of the part becomes more difficult, as described below.

Cemented tungsten carbide parts are generally formed by (1) forming a mixture of WC and a transition metal such as nickel, cobalt or iron by milling, then (2) shaping the mixture into a porous shaped body and (3) sintering the porous shaped body by heating to a temperature greater than the eutectic temperature of the WC and transition metal of the mixture at a pressure sufficient to densify the porous body.

The ultimate minimum grain size of the resultant dense body is controlled by the starting WC powder particle size. However, as WC powders decrease in size below about 0.5 micrometer in diameter, these ultrafine powders tend to cause greater grain growth during the sintering process due to their higher reactivity (greater surface area and corresponding higher surface energy) and tendency to agglomerate, making it difficult to maintain the grain size below about 0.5 micrometer in the densified part. Because the powders are so much smaller, many grains can dissolve locally in the body and, subsequently, accentuate growth by reprecipitation onto Larger nearby grains. In addition, ultrafine powder tends to be agglomerated and, thus, can coalesce into larger particles early in the sintering cycle and act as a large particle causing exaggerated grain growth later in the sintering cycle.

To help control the growth of WC grains, it has been standard practice to add a grain growth inhibitor such as a metal carbide (e.g., VC, $Cr_3C_2$, TaC and NbC) to the WC-transition metal powder mixture. However, it has been difficult to distribute the grain growth inhibitor adequately in parts prepared from ultrafine powders due to their small particle size leading to localized exaggerated grain growth. Because of this distribution problem, generally, large amounts of grain growth inhibitor have been used to adequately control grain growth for bodies prepared from ultrafine powders. Exaggerated grain growth or large amounts of grain growth inhibitor, typically, lead to a decrease of the strength of a body.

Recently, Polizotti, McCandlish and Kugler (U.S. Pat. No. 4,851,041) and McCandlish & Polizzoti, *Solid State Ionics,* 32/33 (1989), pp. 795–801, describe a multiphase composite particle comprising a metal matrix, such as cobalt, having therein a substantially uniform and homogeneous hard phase distribution of particles of a nonmetallic compound, such as tungsten carbide, no larger than about 0.1 micron. The particles are prepared by reductive decomposition of a mixed metal coordination compound or mixed metal metal organometallic precursor, such as $Co(en)_3WO_4$ (en= sethylenediamine), at a temperature sufficient to yield an atomically mixed high surface area reactive intermediate product, followed by carburization reduction of the reactive intermediate in flowing $CO/CO_2$ gas, wherein the carbon and oxygen activity are thermodynamically well controlled to yield the desired powder.

Polizotti, et al. further describe a compacted, multiphase composite article comprising the multiphase composite particles, the particles being compacted by pressing the as synthesized particles, followed by liquid phase sintering to a temperature of 1350° C. in vacuum for a very short time. The only particles and articles that are described are made from $CO(en)_3WO_4$, which would result in a WC-Co cemented carbide having a cobalt concentration of about 23.4 percent by weight.

Wu, Lin, Kear, McCandlish, Eason and Fang, in "Grain Growth Inhibition in Sintering of Nanostructured WC-Co Alloys," Conference: 13$^{th}$ International Plansee Seminar '93, Vol. 3: Coating Technology, Reutte, Tirol, Austria, May 24–28, 1993, pp. 667–679, describe multiphase composite particles having 10 percent by weight cobalt and the sintering of these particles into dense articles. After sintering the aforementioned particles without grain growth inhibitor for 60 seconds, the result ant sintered compact is described as having a grain size of 2 micrometers and a density that has not reached 100 percent of theoretical density. Wu, et al. describe achieving fully dense WC-Co cemented carbide bodies that have grain sizes of less than or equal to 0.5 micrometer when the cemented bodies contain vanadium carbide grain growth inhibitor which had been mechanically added. Wu, et al. also indicate that there is evidence of variation in grain size even in the most heavily grain growth inhibitor doped sample. It is believed that this is a consequence of non-uniform distribution of VC particles in the mechanically mixed starting powder.

It would be desirable to provide a fully dense ultrafine grain size WC-transition metal cemented carbide body that avoids the problems associated with the addition of grain growth inhibitor and method to produce said body.

SUMMARY OF THE INVENTION

An aspect of the invention is a cemented carbide body comprising:

(I) a transition metal binder phase, the transition metal of the transition metal binder phase being selected from the group consisting of iron, nickel, cobalt and mixture thereof, and (II) WC grains dispersed within the metal binder phase, the WC grains having an average WC grain size of at most about 0.5 micrometer in diameter, wherein 99 percent by number of the WC grains have a diameter of at most about 0.8 micron and at least about 50 percent by volume of the WC grains are angular grains and the body: (1) contains an amount of the transition metal ranging from about 3 percent to about 18 percent by weight of the body, (2) is essentially free of grain growth inhibitors and (3) is essentially pore free.

Another aspect of the invention is a method to produce a cemented carbide body, the method comprising:

forming a WC-transition metal mixture by mechanically mixing a source of WC with a source of transition metal, the transition metal being selected from the group consisting of: iron, cobalt, nickel and mixture thereof;

shaping the mixture into a porous body and sintering the porous body at a sintering temperature, superatmospheric pressure and time at temperature and time at superatmospheric pressure sufficient to form a densified WC-transition metal body, the sintering occurring without: the formation of a liquid in the body and at least a portion of the time at superatmospheric pressure is at the sintering temperature, wherein the densified WC-transition metal body is comprised of, (I) a transition metal binder phase, the transition metal of the transition metal binder phase being selected from the group consisting of iron, nickel, cobalt and mixture thereof, and (II) WC grains dispersed within the metal binder phase, the WC grains having an average WC grain size of at most about 0.5 micrometer in diameter wherein 99 percent by number of the WC grains have a diameter of at most about 0.8 micron and at least about 50 percent by volume of the WC grains are angular grains and the body: (1) contains an amount of the transition metal ranging from about 3 percent to about 18 percent by weight of the body, (2) is essentially free of grain growth inhibitors and (3) is essentially pore free.

The cemented carbide bodies of this invention are useful as cutting tools, drills and dies. The bodies may be especially suited for drilling applications requiring small holes such as printed wiring board drills.

DETAILED DESCRIPTION OF THE INVENTION

The WC-transition Metal Body

The WC-transition metal body (i.e., cemented carbide body) of the present invention comprises a transition metal binder phase containing WC grains dispersed therein. It is desirable that at least about 50 percent by volume of the WC grains in the cemented carbide body are angular WC grains, because it is believed that the angular grains improve the toughness of the body. More preferably at least about 80 percent by volume of the WC grains are angular, more preferably at least about 95 percent by volume of the WC grains are angular and most preferably essentially all of the WC grains are angular. Herein, angular grains are grains having a well defined faceted morphology.

Surprisingly, a portion of the WC grains may have plate-like morphology, referred to herein as plates. The amount of plates may comprise up to about 30 volume percent of the WC grains in the body. Preferably at least about 1 percent, more preferably at least about 5 percent, and most preferably at least about 10 percent by volume of the WC grains in the body are plates. The plates, typically, have an aspect ratio (i.e., length:width) from about 2 to about 10 as determined from a micrograph of a polished section of the cemented carbide body. Preferably the aspect ratio ranges from about 3 to about 7.

Figure 1:
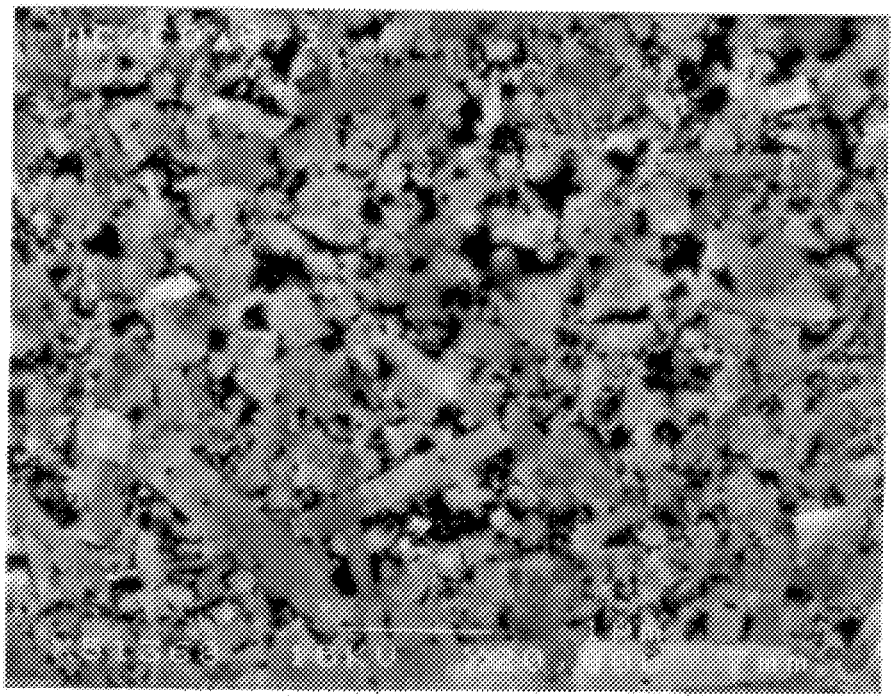
FIG. 1 is a scanning electron microscope micrograph (magnification 20,000) of a polished section of a cemented carbide body essentially free of grain growth inhibitor.

WC grains, other than the aforementioned WC plates, are equiaxed grains, that is to say the aspect ratio is below about 2 to about 1. The equiaxed grains may be present in the body as a bimodal size distribution, the bimodal distribution of the equiaxed grains being preferred over a monomodal distribution. The grains have a bimodal distribution when 2 distinct local maximum exist in the grain size distribution as determined by quantitative stereology described in the next paragraph. FIG. 1 is a representative microstructure of a tungsten carbide-transition metal cemented carbide body essentially free of grain growth inhibitors, which contain plates and a bimodal distribution of equiaxed WC grains.

The WC grains of the cemented carbide body have an average grain size by number of at most about 0.5 micrometer in diameter, as determined by quantitative stereology of a scanning electron micrograph of a polished section of the body using the intercept method described by Underwood in *Quantitative Stereology*, Addison-Wesley, Reading, Mass. (1970). Preferably the WC grains have an average grain size of at most about 0.3 micrometer, more preferably at most about 0.2 micrometer, and most preferably at most about 0.1 to preferably at least about 0.01 micrometer in diameter.

The grain size is further characterized in that at least about 99 percent by number of the grains have a diameter of at most about 0.8 micrometer. Preferably 99 percent of the grains have a diameter that is at most about 0.6 micrometer. Most preferably essentially all of the grains have a diameter of at most about 0.8 micrometer. The diameter referred to in the preceding two paragraphs is the equivalent spherical diameter (i.e., diameter=4 times the grain area divided by pie).

The transition metal binder phase may be a transition metal, a transition metal in solid solution with tungsten and carbon, or mixture thereof. The transition metal is iron, nickel, cobalt or mixture thereof. Preferably the transition metal is cobalt. The amount of transition metal ranges from about 3 percent to about 18 percent by weight of the cemented carbide body. The amount of transition metal is preferably at least about 4 percent to preferably at most about 12 percent, more preferably at most about 10 percent and most preferably at most about 8 percent by weight of the body.

The WC-transition metal carbide body is essentially pore free. Essentially, pore free is when the body displays only isolated pores having a maximum size of about 0.1 micrometer in diameter and being at most about 0.5 percent by volume of the body, as determined by quantitative stereology of a scanning electron micrograph of a polished section of the body, described before. The pores preferably make up at most about 0.25 percent and more preferably at most about 0.1 percent by volume of the body. The maximum pore size is desirably at most about 0.03 micrometer, preferably the maximum pore size is at most 0.02 micrometer and more preferably at most about 0.01 micrometer in diameter.

The cemented carbide body is essentially free of grain growth inhibitors, essentially free being an amount of grain growth inhibitor that has negligible effect upon the grain growth of the part during liquid phase sintering. Herein, a grain growth inhibitor is VC, $MO_2C$, $Cr_3C_2$, NbC, TaC, TiC, ZrC or HfC. Small amounts of grain growth inhibitors may be present in the body essentially free of grain growth inhibitors due to, for example, contamination in the starting materials or contamination introduced during processing. For example, contamination introduced during processing may occur when the WC-transition metal mixture used to make the WC cemented carbide body is prepared by ball milling using WC-Co cemented carbide balls containing a small amount of grain growth inhibitor. Preferably the body essentially free of grain growth inhibitor has a total amount of grain growth inhibitor of at most about 1000 parts per million (ppm), more preferably at most about 800 ppm, even more preferably at most about 500 ppm, and most preferably at most about 250 ppm by weight of the body.

Figure 2:
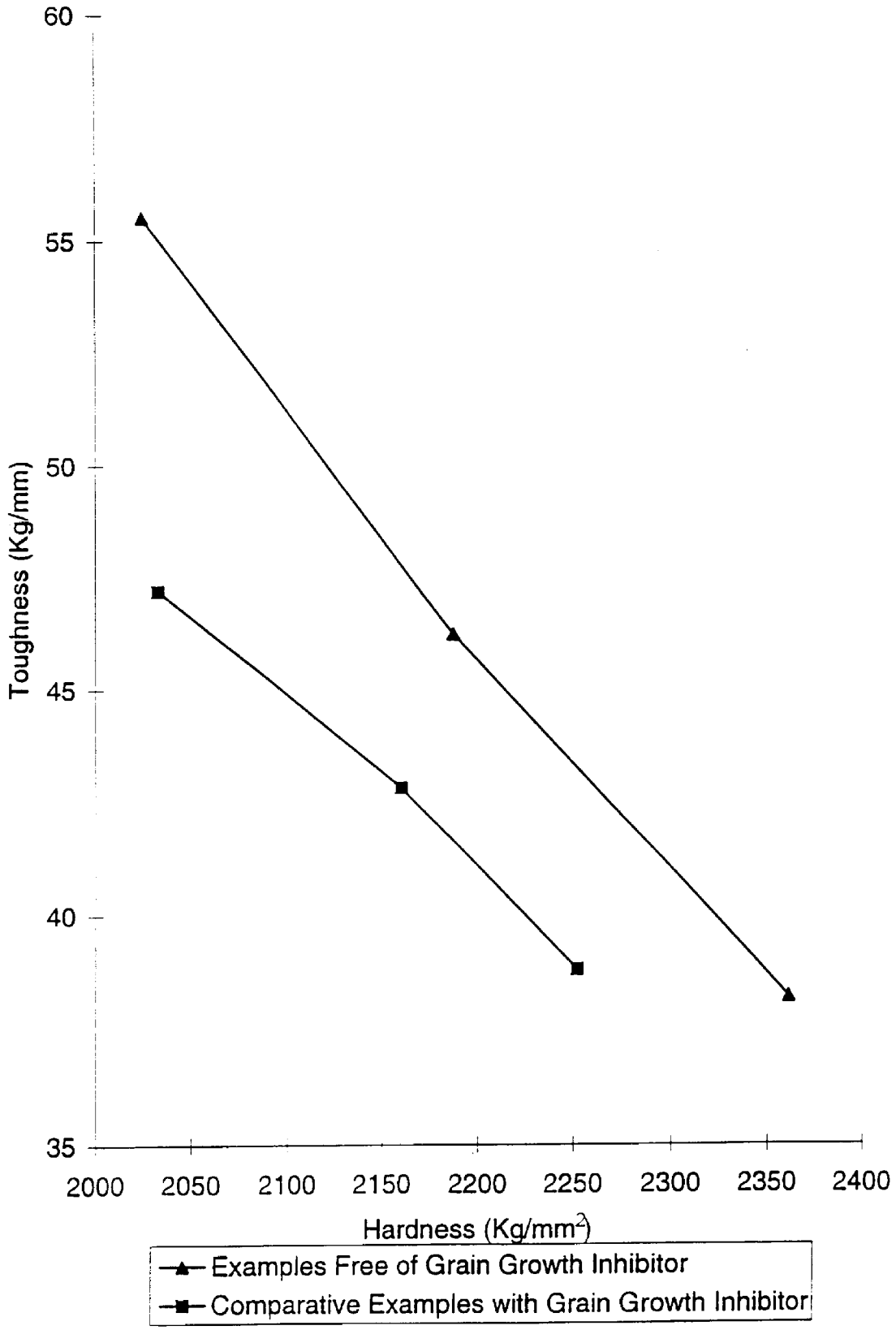
FIG. 2 is a graph of the hardness versus toughness of bodies containing grain growth inhibitor and bodies essentially free of grain growth inhibitor.

The cemented carbide body essentially free of grain growth inhibitor, surprisingly, has improved properties compared to bodies containing a grain growth inhibitor. For example, the body essentially free of grain growth inhibitor has a significantly improved hardness-toughness relationship (see FIG. 2), compared to a WC-cemented carbide containing grain growth inhibitor and having essentially the same grain size and binder metal concentration. FIG. 2 is a plot of hardness versus toughness of WC/6 percent by weight Co bodies having an average WC grain size of less than about 0.5 micrometer in diameter. The points of the plots correspond to the Examples and Comparative Examples of Table 1. The reason for the improved toughness-hardness of the bodies essentially free of grain growth inhibitors is not understood, but may be due to the presence of angular WC grains or WC plates in the microstructure of said bodies.

Method to Produce a WC-transition Metal Body

In forming a WC-transition metal body, a mixture of a source of WC and source of transition metal is formed by mechanical mixing. The tungsten source may be a monotungsten carbide powder which has a mean particle size small enough to realize a WC-transition metal body having a WC average grain size of less than 0.5 micrometer. Desirably, the mean particle size by weight of the WC in the formed mixture is at most about 0.5 micrometer in diameter. Preferably the mean particle size by weight is at most about 0.4, more preferably at most about 0.25, and most preferably at most about 0.1 micrometer in diameter.

The largest particle size of the WC powder is desirably a size less than a size which would cause exaggerated grain growth during sintering. Preferably 99 percent by number of the particles have a diameter of at most about 0.8 micrometer, more preferably at most about 0.6 micrometer, even more preferably at most about 0.4 micrometer and most preferably at most about 0.2 micrometer. The source of WC may also be a composite powder, the composite powder containing tungsten, a transition metal and carbon, such as those described by U.S. Pat. Nos. 4,851,041 and 5,352,269, each incorporated herein by reference.

To avoid phases such as free carbon and eta phases, which adversely affect properties such as wear resistance and strength in a densified WC-transition metal carbide body, the source of WC, as common in the WC-Co cemented carbide industry, desirably has a chemically bound carbon concentration that is within about 0.1 percent by weight of the stoichiometric amount of carbon in monotungsten carbide (i.e., about 6.13 percent by weight). More preferably the carbon concentration is within at least about 0.05 percent by weight of this stoichiometeric amount.

The source of the transition metal may be a metal or metal alloy of a metal selected from the group consisting of cobalt, nickel, iron or a mixture thereof, the metal alloy being an alloy of the aforementioned transition metals or an alloy of at least one of the transition metals with W, C or a mixture of W and C. Preferably, the transition metal is cobalt or an alloy containing cobalt. More preferably the transition metal is cobalt.

The source of the transition metal may be any source such as metal powders or composite powders previously described that can be intimately mechanically mixed with the WC source. Preferably the source of transition metal is a metal powder that has an average particle size that is at most about 10 micrometers in diameter, more preferably at most about 5 micrometers, and most preferably at most about 2 micrometers in diameter. The transition metal powder is desirably of a purity that does not form undesirable phases or promote the formation of undesirable phases such as eta phases in the WC-transition metal body. Preferably the transition metal powder contains an amount of contaminants of at most about 1 percent by weight of the metal powder, contaminants being elements other than C, W, Fe, Co or Ni. More preferably the amount of contaminants is at most about 0.5 percent, and most preferably 0.2 percent by weight of the transition metal powder.

The mixture may also contain organic additives such as binders that improve the ability of the mixture to be shaped into a porous body. Representative binders include paraffin wax, synthetic waxes such as microcrystalline wax, or linear or branched chain polymers such as polyethylene or polypropylene. The binders, typically, are soluble in a solvent such as a straight chain alkane (e.g., heptane) that may be used to mix the components of the mixture together.

The mixture may also contain a source of carbon to adjust for WC that may be substoichiometric in carbon. The source of carbon may be carbon black (e.g., lamp black and acetylene black) or an organic source of carbon such as phenol-formaldehyde resins and epoxy resins.

The mixture is formed by mechanically mixing the source of WC with the source of the transition metal and any optional components, such as organic additives or carbon, previously described. The mechanical mixing may be any convenient form of mechanical mixing, such as ultrasonic agitating, ball milling, attriting, homogenizing and stirring, that intimately mixes the source of WC and source of transition metal. Preferably the source of WC and source of transition metal are mixed by ball milling or attrition. More preferably they are mixed by attrition, wherein the milling media is preferably cemented tungsten carbide-cobalt balls.

When mixing the WC and transition metal source to form the mixture, they may be mixed dry or in a solvent as long as the environment does not deleteriously oxidize or hydrolyze the mixture's components. Preferably the WC and transition metal are mixed in a solvent such as a low molecular weight straight chain alkane such as octane, heptane or hexane, which may be, subsequently, removed by drying, the drying being a convenient method such as vacuum or spray drying.

The mixture is then formed into a porous body by a convenient method such as those known in the art, examples being, uniaxial pressing in hard steel tooling, dry or wet bag cold isostatic pressing in rubber tooling, extrusion and injection molding. The particular method is selected primarily by the shape that is desired. For the present invention, uniaxial pressing, dry or wet bag isopressing produce satisfactory results.

Before sintering the porous body, the body is typically heat treated to remove any organic additives that may have been added to aid processing. This heat treatment, commonly referred to as dewaxing, suitably is performed at a temperature ranging from about 300° C. to 700° C. under vacuum, inert gas or reducing gas. A particularly suitable dewax cycle is heating to about 350° C. under vacuum for a time sufficient to remove most of the organic additives followed by heating to 450° C. in an atmosphere containing hydrogen gas. The porous body is then sintered at a temperature, superatmospheric pressure, time at temperature and time at superatmospheric pressure sufficient to form a densified body, the sintering occurring without the formation of a liquid in the body. The sintering temperature should be sufficiently high enough to cause the porous body to densify at the superatmospheric pressure described herein. The temperature should also be less than a temperature where a liquid phase is formed in the body with little, if any, grain growth of the WC grains. A suitable temperature range is from about 800° C. to about 1250° C., preferably the temperature range is from about 900° C. to about 1200° C., more preferably from about 1000° C. to about 1150° C., and most preferably from about 1050° C. to about 1150° C.

The time at the sintering temperature (time at temperature) is desirably as short as possible while still forming the densified WC-transition metal cemented carbide body. The time should be a time that fails to cause excessive grain growth of the WC grains while still achieving the desired density of the body. Suitable times range from about 1 minute to about 24 hours. Preferably the time is at most about 12 hours, more preferably at most about 6 hours, even more preferably at most about 3 hours, and most preferably at most about 1 hour to preferably at least about 5 minutes, more preferably at least about 10 minutes, and most preferably at least about 15 minutes.

The entire time or only a portion of the time at the sintering temperature may be at the elevated pressure according to this invention (i.e., the time at superatmospheric pressure is less than or equal to the time at temperature). For practical reasons, the time at superatmospheric pressure is advantageously as short as possible while still attaining the densified body. Preferably the time at superatmospheric pressure at the sintering temperature is at most about 30 minutes, more preferably at most about 10 minutes, even more preferably at most about 60 seconds and most preferably at most about 15 seconds to preferably at least about 2 seconds.

The superatmospheric pressure at the sintering temperature should be at least a pressure such that the resulting cemented carbide body is essentially free of porosity, while the mean WC grain size of the cemented carbide body is at most about 0.5 micrometer in diameter. The superatmospheric pressure should be less than a pressure, wherein the body would start to plastically deform to an extent where catastrophic failure of the body may occur. Preferably the superatmospheric pressure is at most about 1,000,000 pounds per square inch "psi" (6.89 GPa), more preferably at most about 500,000 psi (3.45 GPa) to at least about 10,000 (68.9 MPa) psi, more preferably at least about 50,000 psi (345 MPa), and most preferably at least about 100,000 psi (689 MPa).

Representative methods for sintering the porous body include Rapid Omnidirectional Compaction (ROC), hot isostatic pressing (HIP), uniaxial hot pressing, or pressureless or vacuum sintering followed by one of the aforementioned superatmospheric techniques, an example being sinter-HIP. Preferably the method is ROC, various aspects being taught by Timm (U.S. Pat. No. 4,744,943), Lizenby (U.S. Pat. Nos. 4,656,002 and 4,341,557), Rozmus (U.S. Pat. No. 4,428,906) and Kelto (*Metals Handbook*, "Rapid Omnidirectional Compaction" Vol. 7, pages 542–546), each incorporated herein by reference.

In the ROC process, according to the present invention, the porous body is first embedded in a pressure transmitting material that acts like a viscous liquid at the sintering temperature, the material and body being contained in a shell. The porous body may be enveloped in a barrier layer such as graphite foil or boron nitride. Suitable pressure transmitting materials include glasses that have sufficient viscosity so that the glass fails to penetrate the body under an applied pressure. Representative glasses include glasses containing high concentrations of silica and boron. A commercial glass useful in the temperature range from 1000° C. to 1400° C. is Corning-type PYREX 7740™ glass. Pressure transmitting materials are described in more detail in U.S. Pat. Nos. 4,446,100; 3,469,976; 3,455,682 and 4,744,943, each fully incorporated herein by reference.

The shell containing the porous body or porous bodies and pressure transmitting medium preferably forms an enclosed right cylinder that can be placed in pot die tooling of a forging press. The pot die tooling, as it is known in the forging industry, consists of a cylindrical cavity closed at one end by an ejector assembly and at the other by a cylindrical ram. Upon compression in the tooling, the shell must distort predictably and not crack or leak.

The preferred shell material for the temperature range from 150° C. to about 1650° C. using glass pressure transmitting media is a shell cast of a thixotropic ceramic, as described by U.S. Pat. No 4,428,906, at col. 3, lines 58–68, and col. 4, lines 1–27, incorporated herein by reference. The thixotropic ceramic material comprises a ceramic skeleton network and pressure transmitting material that deforms or fractures allowing compression of the pressure transmitting material, while retaining enough structural integrity to keep the pressure transmitting fluid from leaking out of the pot die.

Once the porous body or bodies are embedded in the pressure transmitting material contained in the shell, this shell assembly is heated in an inert atmosphere to a temperature suitable for forging. The temperature of this step is as described previously. The time at temperature must be a time sufficient to completely fluidize the pressure transmitting medium and to bring the porous bodies to a temperature roughly in equilibrium with the temperature of the pressure transmitting material. Typical times range from about 1 to 3 hours for both heating to the sintering temperature and maintaining the sintering temperature. The time at the sintering temperature is maintained generally from about 1 to 30 minutes before being pressed in the pot die of the forging pressed described below.

The heated shell assembly is pressed in a forging press as described below and by Timm, U.S. Pat. No. 4,744,943, at col. 9, lines 50–68, and col. 10, lines 1–3, incorporated herein by reference. The heated shell is pressed in the forging press by compressing the assembly with a ram in a closed cavity such as the pot die tooling previously described. As the ram compresses the assembly in the cavity, the pressure transmitting material exerts a large hydrostatic pressure on the articles to densify them. The shell material of the assembly flows into the clearance between the ram and pot die and forms, in effect, a pressure seal so that the liquid pressure transmitting material does not escape into the pot die. After pressing, the shell assembly is ejected from the pot die.

After ejection from the pot die, the densified bodies are separated from the pressure transmitting material (PTM) by a method such as pouring the liquid PTM through a screen, the densified bodies being retained on the screen which is described in greater detail in Timm, U.S. Pat. No. 4,744,943, at col. 10, lines 5–27, incorporated herein by reference. Any residual material remaining on the bodies may be removed by, for example, sand blasting. The entire assembly may also be cooled to room temperature before removing the densified bodies. The bodies are subsequently removed from the hardened glass PTM, for example, by breaking the glass PTM with a hammer. Further finishing of the densified bodies such as grinding and polishing may be performed.

Test Methods:

The following properties of the densified cemented carbide bodies are determined as follows:

Density is determined by the method described by ASTM B311-58.

Vickers hardness is determined by the method described by ASTM E384 using a load of 30 Kg and a dwell time of 15 seconds.

Palmqvist toughness is determined by the method described by R. Warren and H. Matzke in *Science of Hard Materials*, pp. 563-582, Plenum Press, New York, N.Y. (1983), wherein the indent used to determine the toughness is made by the same method previously described for determining Vickers hardness. The microstructure is characterized by scanning electron microscopy (SEM) of a polished section of a densified cemented carbide body and grain size is determined by the intercept method described by Underwood in *Ouantitative Stereology*, Addison Wesley, Reading, Mass., (1970).

The following examples are solely for illustrative purposes and are not to be construed as limiting the scope of the present invention.

EXAMPLES

Example 1

97.5 Parts by weight of NANOCARB WC/8 percent by weight cobalt powder, available from Nanodyne Inc., New Brunswick, N.J., 2.5 parts by weight of paraffin and enough heptane to make a fluid slurry are attrited for 5 hours in a Union Process 1-S attritor using cemented tungsten carbide/cobalt media. The average WC particle size of the NANOCARB WC/8 percent by weight cobalt powder is about 0.16 micron in diameter as determined by SEM. The powder has a free carbon concentration of about 0.08 percent by weight and a total carbon concentration of about 5.67 percent by weight. Characteristics of the NANOCARB WC/Co powders used herein, and method to make said powders, are further described in U.S. Pat. Nos. 4,851,041 and 5,352,269, each being incorporated herein by reference.

After attriting the above mixture, the heptane is removed by rotary evaporation. The dried powder is uniaxially pressed at a pressure of about 150 MPa into bars having a width and height of about 7 mm and a length of about 20 mm. The pressed bars are wrapped in graphite foil and placed into a fluid die containing PYREX glass frit available from Corning Corp. The fluid die containing the pressed bars is heated to 450° C. under vacuum to remove the paraffin wax from the bars. The fluid die containing the bars is placed in a furnace for 2.5 hours. The furnace is purged continuously with nitrogen and is at 1100° C. (ROC preheat temperature). Upon being placed in the furnace at 1100° C., the fluid die and parts heat up to 1100° C. within about 2.5 hours. The time the fluid die and parts are at the preheat temperature (1100° C.) has been determined to be about 15 to 30 minutes. The fluid die containing the bars, while still at 1100° C., is then rapid omnidirectionally compacted (ROCed) for 10 seconds at 830 MPa. The fluid die is allowed to cool to ambient temperature and the parts are removed from the PYREX glass that is formed from the PYREX frit.

The density, Vickers hardness, Palmquist toughness, and average WC grain size of the bodies prepared by the method of Example 1 appear in Table 1.

The microstructure of Example 1 is shown in FIG. 1. The microstructure shows a major phase of WC grains and cobalt. The WC grains are distributed in the cobalt phase as (1) small equiaxed grains with an average size of about 0.065 micrometer, (2) larger equiaxed grains having an average size of about 0.24 micrometer and (3) plates having an average width of about 0.14 micrometer and length of about 0.56 micrometer. The average grain size of all of the WC grains is about 0.15 micrometer. The percent by volume of the three types of WC and cobalt in the body is as follows:

WC plates: 11.4%

Large equiaxed WC grains: 41.7%

Small equiaxed WC grains: 32.0%

Cobalt: 14.9%

Example 2

The method of Example 1 is repeated except that the powder is NANOCARB WC/6 percent by weight cobalt powder and the ROC preheat temperature is 1000° C. The average WC particle size is about the same size described in Example 1 and the powder has a free carbon concentration of about <0.03 percent by weight, total carbon of about 5.74 percent by weight and metal impurities of about 270 parts per million (ppm) by weight. The characteristics of the resultant body are shown in Table 1.

Example 3

The method of Example 2 is repeated except that the ROC preheat temperature is 1100° C. The characteristics of the resultant body are shown in Table 1.

Example 4

The method of Example 1 is repeated except that the powder is NANOCARB WC/10 percent by weight cobalt powder. The average WC particle size is about the same as described in Example 1 and the powder has a free carbon concentration of about 0.10 percent by weight, total carbon of about 5.65 percent by weight and metal impurities of less than about 200 parts per million by weight. The characteristics of the resultant body are shown in Table 1.

Example 5

The method of Example 1 is repeated except that about 94 pbw of Dow ultrafine WC powder is attrited for about 6 hours with about 6 pbw Stark extra-fine cobalt powder and about 2 pbw paraffin wax and the ROC preheat temperature is about 1150° C. The Dow ultrafine powder is prepared by the method described in U.S. Pat. No. 5,380,688 and the WC has an average particle size of about 0.1 micron, a free carbon concentration of about 0.01 percent by weight and a total carbon concentration of about 6.14 percent by weight. The Stark cobalt powder has an average particle size of about 1 micrometer. The characteristics of the resultant body are shown in Table 1.

Comparative Example A

The method of Example 5 is repeated except that the ROC preheat temperature is about 1200° C. and 0.3 pbw of Vanadium Carbide (VC) available from Aldrich Co., Milwaukee, Wis. (Catalog No. 33,632–7) and 0.3 pbw of Chromium Carbide ($Cr_3C_2$), available from Tokyo Tungsten, Tokyo, Japan, are attrited with the WC powder, cobalt powder and paraffin wax. The VC has an average particle size of about 1.5 to 2 micrometers in diameter and the $Cr_3C_2$ has an average particle size of about 1.4 micrometers in diameter. The characteristics of the resultant body are shown in Table 1.

Comparative Example B

The method of Comparative Example A is repeated except that (1) the WC powder is Dow ultrafine powder having an average particle size of about 0.2 micrometer, (2) the paraffin wax is replaced by polyethylene glycol and (3) instead of attriting the powders together they are ball milled in heptane for 40 hours using cemented tungsten carbide/Co media. The characteristics of the resultant body are shown in Table 1.

Comparative Example C

Comparative Example C is a sintered tungsten carbide-cobalt cemented carbide part containing about 6 percent by weight cobalt, about 0.6 percent by weight VC and 0.3 percent weight $Cr_3C_2$, available from AB Sandvik Hard Materials, Stockholm, Sweden, under the trade name 6UF GRADE. The characteristics of the body are shown in Table 1.

TABLE 1

| | WC Powder Type | Cobalt Concentration (wt. %) | Added Grain Growth Inhibitor (wt. %) | Densification Process | Densification Temperature (°C.) | Density (g/cc) | Vickers Hardness (Kg/mm$^2$) | Palmqvist Toughness (Kg/mm) | Average Grain Size (Micrometer) |
|---|---|---|---|---|---|---|---|---|---|
| Example | | | | | | | | | |
| 1 | NANOCARB | 8 | 0 | ROC | 1100 | 14.60 | 1929 | 61.3 | 0.15 |
| 2 | NANOCARB | 6 | 0 | ROC | 1000 | 14.86 | 2361 | 38.2 | Not measured |
| 3 | NANOCARB | 6 | 0 | ROC | 1100 | 14.92 | 2187 | 46.2 | Not measured |
| 4 | NANOCARB | 10 | 0 | ROC | 1100 | 14.51 | 1936 | 63.7 | Not measured |
| 5 | Dow Ultrafine (0.1 $\mu$m) | 6 | 0 | ROC | 1150 | 14.88 | 2025 | 55.5 | 0.35 |
| Comparative Example | | | | | | | | | |
| A | Dow Ultrafine (0.1 $\mu$m) | 6 | 0.3 VC 0.3 $Cr_3C_2$ | ROC | 1200 | 14.78 | 2252 | 38.8 | Not measured |
| B | DOW Ultrafine (0.2 $\mu$m) | 6 | 0.3 VC 0.3 $Cr_3C_2$ | ROC | 1200 | 14.67 | 2160 | 42.8 | Not measured |
| C | — | 6 | 0.6 VC 0.3 $Cr_3C_2$ | Pressureless Sinter | 1450 | 14.75 | 2033 | 47.2 | 0.27 |

From Table 1 the hardness and toughness data for Examples 2, 3 and 5 and Comparative Examples A, B and C have been plotted in FIG. 2. As can be seen in FIG. 2, the cemented carbides free of grain growth inhibitor of this invention have an improved toughness-hardness relationship (i.e., the plot is shifted to the right and up) compared to cemented carbides containing grain growth inhibitor and having comparable Co content and WC grain size.

What is claimed is:

1. A cemented carbide body comprising:

(I) a transition metal binder phase, the transition metal of the transition metal binder phase being selected from the group consisting of iron, nickel, cobalt and mixture thereof, and (II) WC grains dispersed within the metal binder phase, the WC grains having an average WC grain size of at most about 0.5 micrometer in diameter wherein 99 percent by number of the WC grains have a diameter of at most about 0.8 micron and at least about 50 percent by volume of the WC grains are angular grains and the body: (1) contains an amount of the transition metal ranging from about 3 percent to about 18 percent by weight of the body, (2) is essentially free of grain growth inhibitors and (3) is essentially pore free.

2. The body of claim 1 wherein the average grain size is at most about 0.3 micrometer in diameter.

3. The body of claim 2 wherein the average grain size is at most about 0.2 micrometer in diameter.

4. The body of claim 1 wherein the amount of transition metal in the body ranges from about 4 percent to about 18 percent by weight of the body.

5. The body of claim 4 wherein the amount of transition metal ranges from about 4 percent to about 12 percent by weight of the body.

6. The body of claim 5 wherein the amount of transition metal ranges from about 4 percent to about 10 percent by weight of the body.

7. The body of claim 1 wherein at least 80 percent by volume of the WC grains are angular WC grains.

8. The body of claim 1 wherein at least 95 percent by volume of the WC grains are angular WC grains.

9. The body of claim 1 wherein at least about 1 percent to about 30 percent by volume of the WC grains are plates.

10. The body of claim 1 wherein the transition metal is cobalt.

11. A method to produce a cemented carbide body, the method comprising:

forming a WC-transition metal mixture by mechanically mixing a source of WC with a source of transition metal, the transition metal being selected from the group consisting of iron, cobalt, nickel and mixture thereof;

shaping the mixture into a porous body and sintering the porous body at a sintering temperature, superatmospheric pressure and time at temperature and time at superatmospheric pressure sufficient to form a densified WC-transition metal body, the sintering occurring without the formation of a liquid in the body and at least a portion of the time at superatmospheric pressure is at the sintering temperature, wherein the densified WC-transition metal body is comprised of, (I) a transition metal binder phase, the transition metal of the transition metal binder phase being selected from the group consisting of iron, nickel, cobalt and mixture thereof and (II) WC grains dispersed within the metal binder phase, the WC grains having an average WC grain size of at most about 0.5 micrometer in diameter wherein 99 percent by number of the WC grains have a diameter of at most about 0.8 micron and at least about 50 percent by volume of the WC grains are angular grains and the body: (1) contains an amount of the transition metal ranging from about 3 percent to about 18 percent by weight of the body, (2) is essentially free of grain growth inhibitors and (3) is essentially pore free.

12. The method of claim 11 wherein the source WC is a composite powder containing W, C and the transition metal.

13. The method of claim 11 wherein the transition metal is cobalt.

14. The method of claim 11 wherein the superatmospheric pressure is applied by rapid omni directional compaction.

15. The method claim 11 wherein the time at superatmospheric pressure is less than the time at temperature.

16. The method of claim 11 wherein the time at superatmospheric pressure is from about 2 seconds to 10 minutes.

17. The method of claim 16 wherein the time at superatmospheric pressure is from about 2 seconds to about 1 minute.

18. The method of claim 11 wherein the time at temperature is from about 10 minutes to about 6 hours.

19. The method of claim 17 wherein the time at temperature is from about 15 minutes to about 1 hour.

20. The method of claim 11 wherein the mechanical mixing is milling.

21. The method of claim 11 wherein the superatmospheric pressure is at least about 10,000 pounds per square inch.

22. The method of claim 21 wherein the superatmospheric pressure is at most about 1,000,000 pounds per square inch.

* * * * *